US005819812A

United States Patent [19]

Bortoli et al.

[11] Patent Number: 5,819,812

[45] Date of Patent: Oct. 13, 1998

[54] GIVER GRIPPER FOR A GRIPPER LOOM

[75] Inventors: Giulio Bortoli, Schio; Luciano Corain, Vicenza, both of Italy

[73] Assignee: Nuovo Pignone S.p.A., Italy

[21] Appl. No.: 806,955

[22] Filed: Feb. 26, 1997

[30] Foreign Application Priority Data

Feb. 22, 1996 [IT] Italy ..... MI96A0365

[51] Int. Cl.[6] ..... D03D 47/23

[52] U.S. Cl. ..... 139/448

[58] Field of Search ..... 139/448

[56] References Cited

U.S. PATENT DOCUMENTS

| | | | |
|---|---|---|---|
| 3,915,201 | 10/1975 | Mackie | 139/448 |
| 3,934,621 | 1/1976 | Tosches . | |
| 3,960,183 | 6/1976 | Flamand . | |
| 4,071,055 | 1/1978 | Haltmeier et al. | 139/448 |
| 5,341,852 | 8/1994 | Corain et al. | 139/448 |
| 5,348,057 | 9/1994 | Corain et al. | 139/448 |

FOREIGN PATENT DOCUMENTS 2 018 307 10/1979 United Kingdom .

*Primary Examiner*—Andy Falik

*Attorney, Agent, or Firm*—Nixon & Vanderhye P.C.

[57] ABSTRACT

A giver gripper for a gripper loom comprising a gripper body having a substantially U-shaped cross section including a base and two laterally spaced side walls, one of the side walls adapted to be closer to an associated loom reed, the laterally spaced side walls each having a forward vertical portion, wherein a forwardmost point of the forward vertical portion of the one of the side walls projecting more forwardly than the other of the forward vertical portions; a cover member located on the gripper body between the laterally spaced side walls, the cover having a forward tip located substantially between the forward vertical portions of the side walls, the forward tip having a height greater than the base of the gripper body and less than the forward vertical portions of the side walls; a gripping member for a weft yarn positioned on the base adjacent of the side walls; a guide and positioning groove for the weft yarn; a deflector for maintaining the weft yarn inclined within the giver gripper; wherein the cover is removably mounted on the gripper body between the one of the side walls and the gripping member, and further wherein the guide and positioning means are provided on one edge of the cover closer to the one of the side walls and the deflector is provided on an opposite edge of the cover closer to the other of the side walls.

7 Claims, 1 Drawing Sheet

GIVER GRIPPER FOR A GRIPPER LOOM

BACKGROUND AND SUMMARY OF THE INVENTION

This invention relates to a giver gripper for a gripper loom which, in addition to being of high performance, is of extremely simple construction making it economical and advantageous, in that those elements most subject to wear are now formed as a single piece which is mounted on the gripper body in an easily removable manner.

In a gripper loom, the purpose of the giver gripper, mounted at one end of a transporter tape driven with reciprocating motion, is to grip a weft yarn external to the shed formed by the warp yarns, drag the weft yarn into said open shed as far as the center thereof and return to its starting point in order to be able to grip a new weft yarn after yielding its own weft yarn to a taker gripper the purpose of which, also mounted at one end of a second transporter tape driven with reciprocating motion, is to complete the insertion of the weft yarn by dragging it out of the other end of the shed.

It will be clear from the description above that the operation of the grippers, and in particular the giver gripper, is of basic importance in the correct operation of a loom. In this respect, the giver gripper has to be able to grip the weft yarn in such a manner as to maintain it reliably clamped, but without altering the yarn properties, as far as the center of the shed. It therefore requires suitable and appropriate weft yarn guide and gripping members which must also allow effective and reliable transfer of the yarn to the taker gripper. Moreover, as the giver (gripper is inserted into and slides within the shed formed by the warp yarns, it inevitably stresses the yarns and must therefore be shaped such that the stressing does not damage or indeed break the warp yarns. Finally, each giver gripper comprises parts which are inevitably subject to wear due to the continuous sliding of the weft yarn, which could create roughness which is dangerous for the yarn integrity. Consequently, the gripper must be subjected to continuous inspection because the quality of the fabric formed depends on its perfect operation. It is therefore apparent that there is a continuous search for increasingly improved giver grippers to achieve increasingly better results.

A large variety of giver grippers for gripper looms are already known in the state of the art. The type currently most often used is a one-piece giver gripper with a basic structure substantially of U-shape, with two vertical lateral points at the front (the one closer to the reed projecting more forwardly than the other), the points being higher than the front tip of the horizontal cover which lies between the two vertical points. That vertical wall of the basic structure closer to the reed is provided with a guide and positioning groove for the weft yarn, a gripping member being arranged on the opposite side of the gripper longitudinal to the groove, a vertical deflector being provided between the guide groove and the gripping member to arrange the yarn with an inclination of not more than 45°, so as to facilitate the withdrawal of the yarn by the taker gripper.

Such a giver gripper has proved to be of high performance, but has the drawback of not allowing economical and rapid servicing of its wearable parts.

In this respect, as is well known to the expert of the art, the critical points of a giver gripper are the inner end of the guide and positioning groove for the weft yarn and the inclined front face of the deflector, in which the sliding of the weft yarn produces wear which can compromise the proper operation of the gripper and can create roughness which is dangerous for the weft yarn integrity.

With known giver grippers representing the state of the art, when gripper wear arises, the entire gripper has to be replaced, with evident considerable economical loss.

The object of the present invention is to obviate the above drawback by providing a giver gripper which is of simple construction and hence of low cost, and which allows rapid replacement of just the worn parts, with a consequent considerable reduction in the loom operating cost.

This is substantially attained in that the wearable parts of the giver gripper are formed as a single easily removable element of the gripper, generally its cover.

Hence, the present invention provides a giver gripper for a gripper loom comprising a gripper body having a substantially U-shaped cross section including a base and two laterally spaced side walls, one of the side walls adapted to be closer to an associated loom reed, the laterally spaced side walls each having a forward vertical portion, wherein a forwardmost point of the forward vertical portion of the one of the side walls projecting more forwardly than the other of the forward vertical portions; a cover member located on the gripper body between the laterally spaced side walls, the cover having a forward tip located substantially between the forward vertical portions of the side walls, the forward tip having a height greater than the base of the gripper body and less than the forward vertical portions of the side walls, a gripping member for a weft yarn positioned on the base adjacent of the side walls; a guide and positioning groove for the weft yarn; a deflector for maintaining the weft yarn inclined within the giver gripper; wherein the cover is removably mounted on the gripper body between the one of the side walls and the gripping member, and further wherein the guide and positioning means arc provided on one edge of the cover closer to the one of the side walls and the deflector is provided on an opposite edge of the over closer to the other of the side walls.

In this manner, in the case of wear it is sufficient to merely to replace the removable cover, and continue to use the same gripper body, with evident saving.

According to a preferred embodiment of the present invention, the cover member is removably mounted to the gripper body along a third wall extending upwardly from the base adjacent one side of the gripper member closer to tile one wall.

Finally, according to a further preferred embodiment of the present invention, the guide and positioning groove for the weft yarn extends within the cover approximately as far as the central longitudinal axis thereof, so as to arrange the weft yarn, in cooperation with the deflector and the gripping member, with an inclination greater than 45° to the base of the gripper body, and preferably with an inclination of about 60°.

The invention is described in detail hereinafter with reference to the accompanying drawing, which illustrates a preferred embodiment thereof given by way of non-limiting example only, in that technical or constructional modifications can be made thereto without leaving the scope of the present invention.

DETAILED DESCRIPTION OF THE DRAWINGS

Figure 1:
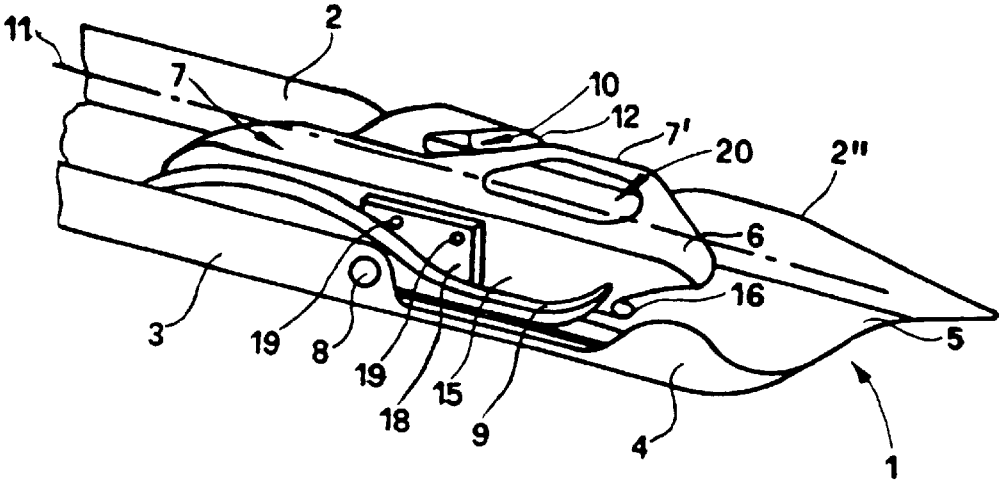
FIG. 1 is a perspective view of a giver gripper formed in accordance with the present invention.

In the figures, the reference numeral 1 indicates the gripper body of a giver gripper for a gripper loom, formed in accordance with the invention. The gripper body 1 consists substantially of a box body of U cross-section, the vertical lateral walls 2 and 3 of which terminate frontally in two vertical points, 2" and 4, respectively. The vertical point 2", which is that closer to the loom reed (not shown), projects more forward than the other point 4, the two vertical points 2" and 4 rising to a height slightly greater than the height, from the base 5 of the gripper body 1. of the horizontal tip 6 of the removable cover 7, which extends between the vertical points 2" and 4. To that vertical lateral wall 3 of the gripper body 1 further from the reed (not shown), there is hinged at 8 the gripping member 9 for the weft yarn. The removable cover, which is positioned between the gripping member 9 and the vertical wall 2, is provided on that side in correspondence with the wall 2 and hence on that edge 7' closer to the reed (not shown), with a weft yarn guide and positioning groove 10 which extends from the edge 7' nearly as far as the central longitudinal axis 11 of the cover 7, and with as vertical wall 12.

Figure 2:
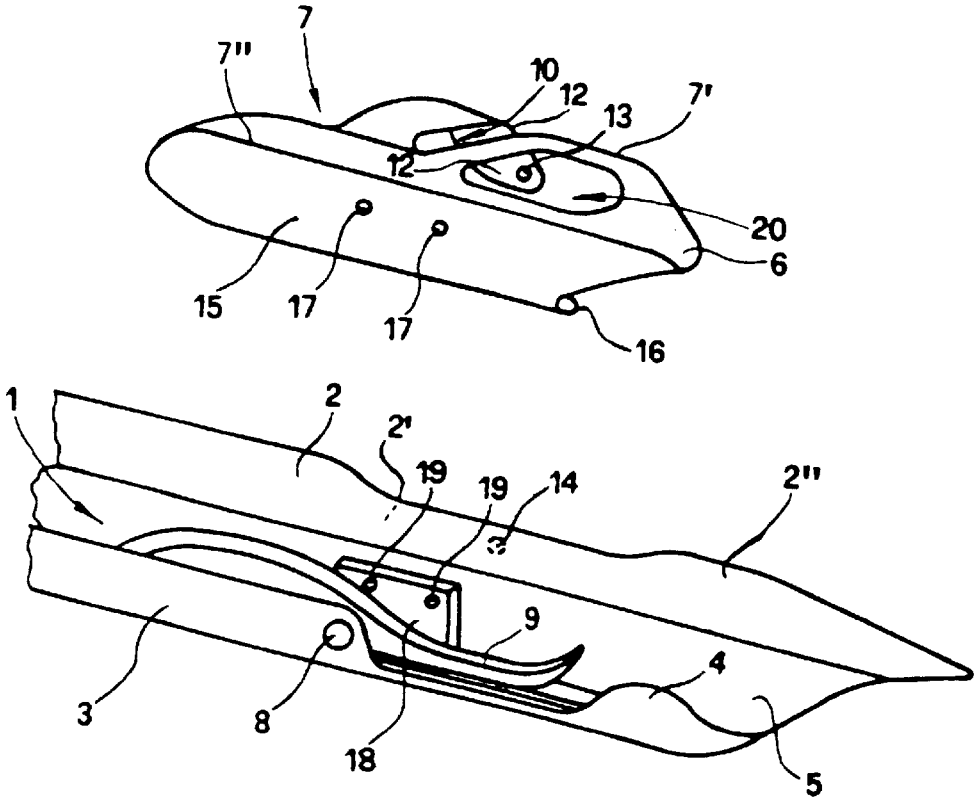
FIG. 2 is a perspective view of the giver gripper of FIG. 1, with the removable cover detached from the gripper body.

The vertical wall 12 comprises at its lower end a hole 13 (see specifically FIG. 2) arranged to cooperate with a centering pin 14 projecting from the outer surface 2' of the wall 2.

The removable cover 7 is also provided, on its other edge 7" further from the reed (not shown), with a wall 15 which extends towards the base 5 to form a deflector 16 which, in cooperation with the groove 10 and the gripping member 9, maintains the weft yarn inclined within the giver gripper at an inclination greater than 45° to the base 5. Finally, the cover 7 is removably locked in position by screws passing through holes 17 in the wall 15 of the cover and screwed into holes 19 in a wall 18 of the gripper body 1, which rises in correspondence with that side of the gripping member closer to the reed (not shown).

The figures also show a lightening hole 20 provided in the cover 7.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A giver gripper for a gripper loom comprising:

a gripper body having a substantially U-shaped cross section including a base and two laterally spaced side walls, one of said side walls adapted to be closer to an associated loom reed, said laterally spaced side walls each having a forward vertical portion, wherein a forwardmost point of said forward vertical portion of said one of said side walls projects more forwardly than the other of said forward vertical portions;

a cover member located on said gripper body between said laterally spaced side walls, said cover having a forward tip located substantially between said forward vertical portions of said side walls, said forward tip having a height greater than the base of said gripper body and less than said forward vertical portions of said side walls;

a gripping member for a weft yarn positioned on said base adjacent the other of said side walls;

a guide and positioning groove for the weft yarn;

a deflector for maintaining the weft yarn inclined within the giver gripper;

wherein said cover is removably mounted on said gripper body between said one of said side walls and said gripping member, and further wherein said guide and positioning means are provided on one edge of said cover closer to said one of said side walls and said deflector is provided on an opposite edge of said cover closer to said other of said side walls.

2. The giver gripper of claim 1 wherein said cover member is removably mounted to said gripper body along a third wall extending upwardly from said base adjacent one side of said gripper member closer to said one wall.

3. The giver gripper of claim 2 wherein said cover member is provided with a first wall extending down from said one edge of said cover to form said deflector, and wherein said first wall of said cover engages said third wall of said gripper body.

4. The giver gripper of claim 3 wherein said cover member is provided with a second wall closer to said one side wall of said gripper body, said second wall having a hole therein arranged to cooperate with a centering pin projecting from an outer surface of said one side wall.

5. The giver gripper of claim 1 wherein said guide and positioning groove for the weft yarn extends within said cover approximately as far as a central longitudinal axis thereof, so as to arrange the weft yarn, in cooperation with said deflector and said gripping member, with an inclination greater than 45° to said base of said gripper body.

6. The giver gripper of claim 5 wherein said inclination of the weft yarn to said base of said gripper body is about 60°.

7. A giver gripper for a gripper loom comprising:

a gripper body having a substantially U-shaped cross section including a base and two laterally spaced side walls, one of said side walls adapted to be closer to an associated loom reed, said laterally spaced side walls each having a forward vertical portion;

a cover member located on said gripper body between said laterally spaced side walls, said cover having a forward tip located substantially between said forward vertical portions of said side walls;

a gripping member for a weft yarn positioned on said base adjacent the other of said side walls;

a guide and positioning groove for the weft yarn;

a deflector for maintaining the weft yarn inclined within the giver gripper;

wherein said cover is removably mounted on said gripper body between said one of said side walls and said gripping member.

* * * * *